US005520382A

United States Patent [19]

Nakajima

[11] Patent Number: 5,520,382

[45] Date of Patent: May 28, 1996

[54] SHEET TRANSFER DEVICE OPERATIVE AGAINST SHEET WITH FLEXIBLE TRANSFER FORCE

[75] Inventor: Kenichi Nakajima, Tokyo, Japan

[73] Assignee: Riso Kagaku Corporation, Tokyo, Japan

[21] Appl. No.: 289,106

[22] Filed: Aug. 11, 1994

[30] Foreign Application Priority Data

Aug. 23, 1993 [JP] Japan ..... 5-229432

[51] Int. Cl.[6] ..... B65H 29/70

[52] U.S. Cl. ..... 271/188; 271/196; 271/94; 271/112

[58] Field of Search ..... 271/196, 314, 271/209, 188, 94, 112; 198/689.1, 471.1

[56] References Cited

U.S. PATENT DOCUMENTS 5,186,451 2/1993 Hirao ..... 271/196

FOREIGN PATENT DOCUMENTS

| | | | |
|---|---|---|---|
| 0053035 | 6/1982 | European Pat. Off. . | |
| 0313088 | 4/1989 | European Pat. Off. . | |
| 1761183 | 4/1971 | Germany . | |
| 1761080 | 4/1971 | Germany . | |
| 60-148866 | 8/1985 | Japan . | |
| 60-148864 | 8/1985 | Japan . | |
| 62-185652 | 8/1987 | Japan | 271/196 |

*Primary Examiner*—David H. Bollinger
*Attorney, Agent, or Firm*—Watson Cole Stevens Davis

[57] ABSTRACT

A sheet guide surface is provided with an air intake port through which a circumferential portion of a fan rotor of a fan for drawing air radially inwardly through the air intake port projects above the sheet guide surface so that the sheet is drawn onto the sheet guide surface at the position of the air intake port while contacting the circumferential portion of the fan rotor thereby being applied with a flexible driving force in the sheet transfer direction due to the rotation of the fan rotor.

9 Claims, 4 Drawing Sheets

SHEET TRANSFER DEVICE OPERATIVE AGAINST SHEET WITH FLEXIBLE TRANSFER FORCE

BACKGROUND OF THE INVENTION

1. Field of the Invention

The present invention relates generally to the art of transferring a thin plate material such as paper or the like (simply called "sheet" hereinbelow), and more particularly to a sheet transfer device for transferring a sheet discharged from a nipping region between a printing drum and a back press roller of a rotary printer with one surface thereof being applied with a printing according to a rotation of the printing drum to a sheet receiving means such as a sheet receptacle.

2. Description of the Prior Art

The Belt conveyers are well known as a means for transferring articles, and of course a transfer of sheet can also be readily accomplished by using a belt conveyer. In the art of printing machines, a sheet transfer device using a belt conveyer for transferring a sheet discharged from a nipping region between a printing drum and a back press roller with a surface thereof being applied with a printing according to a rotation of the printing drum to a sheet receptacle has been proposed by Japanese Patent Laid-open Publication 60-148864, wherein a rear surface portion of the belt conveyer is evacuated to hold the sheet on the belt conveyer by vacuum. By the rear surface of the belt conveyer being evacuated, a sheet applied with a printing on its upper surface is definitely held on the belt conveyer, requiring no means to directly touch the upper surface of the printed sheet for the sheet being definitely transferred to the sheet receptacle, together with an additional function available that the sheet which would remain as adhered onto the printing drum due to a strong viscosity of printing ink as in a stencil printing is effectively peeled off from the printing drum with no means to touch the printed surface of the sheet. Further, as was proposed in the above-mentioned publication, when raised portions are provided at an end portion of the sheet transfer route of the belt conveyer so as to engage the rear surface of the sheet at opposite side edge portions thereof so as thereby to lift the opposite side edge portions of the sheet relative to a central portion thereof held on the conveyer by vacuum, so that the sheet is thereby bent into a U-shape according to the progress of transfer, even a thin sheet is endowed with a rigidity which contributes to transferring the sheet definitely to the very end of the sheet receptacle.

However, in the construction that a sheet is transferred by a belt conveyer evacuated at the rear surface thereof as held thereon by vacuum as described above, it is required that the operation speed of the belt conveyer is correctly synchronized with the rotation speed of the priming drum, and therefore a large scaled drive connection mechanism is required for drivingly connecting the belt conveyer with the priming drum, thereby inducing a high cost of the printing machine, and in addition the increase of the printing speed is obstructed by the inertia of the drive connection mechanism. Further, in order to evacuate the rear surface of the belt conveyer, a relatively large housing is required to enclose the rear side of the belt conveyer, and a fan of a large capacity is required to evacuate a large amount of air from the inside of such a large housing, obstructing down sizing of the printing machine and reduction of the manufacturing cost.

SUMMARY OF THE INVENTION

In view of the above-mentioned situations with regard to the transfer of a sheet discharged from a printing drum to a sheet receptacle that although it is desirable to apply a relatively strong force to the sheet in the direction of transfer, a vacuum type belt conveyer, when used for such a purpose, necessitates a synchronized control of transfer speed, it is an object of the present invention to provide a novel sheet transfer device which solves the above-mentioned problems such that although it applies a relatively strong transfer force to a sheet, the force is highly resilient.

According to the present invention, the above-mentioned problem is accomplished by a sheet transfer device comprising a sheet guide surface, and a fan having a fan rotor which draws air therein from a circumferential region thereof radially inwardly, said fan having an air intake port open at a part of said sheet guide surface with a circumferential portion of said fan rotor projecting from said air intake port above said sheet guide surface, said circumferential portion of said fan rotor projecting above said sheet guide surface being adapted to move in a direction of transfer of a sheet on said sheet guide surface.

A sheet transfer device of the above-mentioned construction may be arranged at a position to transfer a sheet discharged from a nipping region between a printing drum and a back press roller with a first surface thereof being applied with a printing according to a rotation of said printing drum toward a sheet receptacle, wherein said sheet guide surface may slidably receive the sheet discharged from said nipping region along a second surface thereof opposite to said first surface.

In the above-mentioned sheet transfer device, said circumferential portion of said fan rotor projecting above said sheet guide surface may comprise an annular portion for increasing frictional contact with the sheet. This includes a case that the circumferential portion of said fan rotor projecting above said sheet guide surface comprises an annular member for increasing frictional contact with the sheet and a case that the fan rotor projects above the sheet guide surface only at a portion thereof which is modified to provide an increased friction.

Further, in the above-mentioned sheet transfer device, it is desirable that a position at which said circumferential portion of said fan rotor projects above said sheet guide surface is less distant from said nipping region along a route of transfer of the sheet than a length of the sheet in a direction of transfer thereof.

Further, in the above-mentioned sheet transfer device, said sheet guide surface may include a pair of raised portions at a position downstream of said circumferential portion of said fan rotor projecting thereabove as viewed in the direction of transfer of the sheet so as to lift opposite side edge portions of the sheet above a central portion thereof so as thereby to bend the sheet into a U-shape as viewed in the direction of transfer of the sheet.

Further, in the above-mentioned sheet transfer device, said fan rotor may have a larger diameter at opposite end portions thereof corresponding to opposite side portions of said sheet guide surface than at a central portion thereof. Such a difference in diameter along the axial position thereof may be provided by a combination of a plurality of fan rotors. Further, in the above-mentioned sheet transfer device, at least two sets of said fan rotor and said air intake port may be provided along said sheet guide surface as spaced from one another in the direction of transfer of sheet.

Further, in the above-mentioned sheet transfer device, a pair of said fan rotors may be provided with a symmetrical inclination relative to the direction of transfer of sheet together with a corresponding pair of said air intake ports so as to bend a sheet transferred thereby into a U-shape as viewed in said direction of transfer of the sheet.

In the sheet transfer device of the above-mentioned construction, the fan rotor may be rotated at such a rotation speed that provides a circumferential speed higher than a sheet transfer speed so that a vacuum sufficient to draw a sheet to the air intake port thereof is generated, while the sheet is driven in the transfer direction under a light frictional contact with a circumferential portion of the fan rotor which is always shifting relative to the sheet in the sheet transfer direction. According to this construction, although a relatively strong force is applied to the sheet from the fan rotor in the sheet transfer direction, the force is highly resilient, and therefore, when the movement of the sheet is restricted by any other means, the movement of the sheet can follow said other restricting means under a continuous application of the transfer force in the sheet transfer direction.

Particularly when the above-mentioned sheet transfer device is provided at a sheet discharge portion of a printing machine, a sheet discharged from the nipping region of the printing machine according to the rotation of its printing drum moves in a manner of sliding on the sheet guide surface of the sheet transfer device in the sheet transfer direction, and when the leading edge of the sheet reaches the air intake port open at a portion of the sheet guide surface to come into contact with the circumferential portion of the fan rotor projecting above the air intake port, the sheet is drawn onto the sheet guide surface at that portion while the sheet is driven in the sheet transfer direction toward the sheet receptacle by a frictional contact with the circumferential portion of the rotating rotor. In this case, since the driving function applied to the sheet by a frictional contact thereof with the circumferential portion of the rotating fan rotor is effected by a frictional sliding contact at a relatively small surface between the circumferential portion of the rotor and the rear surface of the sheet, when the rotor is rotated at such a speed that the circumferential speed of the fan rotor is substantially higher than that of the sheet transfer speed, even when a trailing portion of the sheet is still in contact with the printing drum such that the transfer of the sheet is restricted by the rotation of the printing drum, the sheet is continually applied with a resilient driving force in the transfer direction from the fan rotor regardless of changes of the rotation speed of the printing drum, allowing the fan rotor to be operated at high flexibility of rotation speed not required to be synchronized with the rotation of the printing drum. This flexible sheet transfer function available by the fan rotor can increase the sheet transfer speed starting at a moment when the trailing end of the sheet is released from the contact with the printing drum, and therefore, even in the printing operation where the printing drum is rotated at a relatively moderate speed, the sheet can be given a high transfer speed after it has been released from the printing drum such that the sheet is always definitely transferred to the very end of the sheet receptacle regardless of the rotation speed of the printing drum.

Further, in the sheet transfer device according to the above-mentioned construction, since the fan rotor may simply be rotated in operation, the fan rotor may be directly connected with an electric motor so as to be directly driven thereby, and therefore the construction of the moving parts of the device can be extremely simplified. In this case, the power of the electric motor is mostly required for rotating the fan rotor to let it draw air in through the air intake port. Therefore, the fan rotor carries out its primary function as a fan, and further carries out a composite function that it additionally provides the sheet transfer function by a part of the means thereof for carrying out the primary function, i.e. a circumferential portion thereof, while fulfilling the primary function. Therefore, except when a particular means such as an annular rubber belt is mounted around the fan rotor in order to increase the friction in the contact with the sheet, no substantially additional means are required to provide the sheet transfer function.

BRIEF DESCRIPTION OF THE DRAWING

In the accompanying drawing,

FIG. 7 is a schematic view showing still another embodiment of the sheet transfer device according to the present invention; and.

DESCRIPTION OF THE PREFERRED EMBODIMENT

In the following the present invention will be described in more detail with respect to some embodiments with reference to the accompanying drawings.

Figure 1:
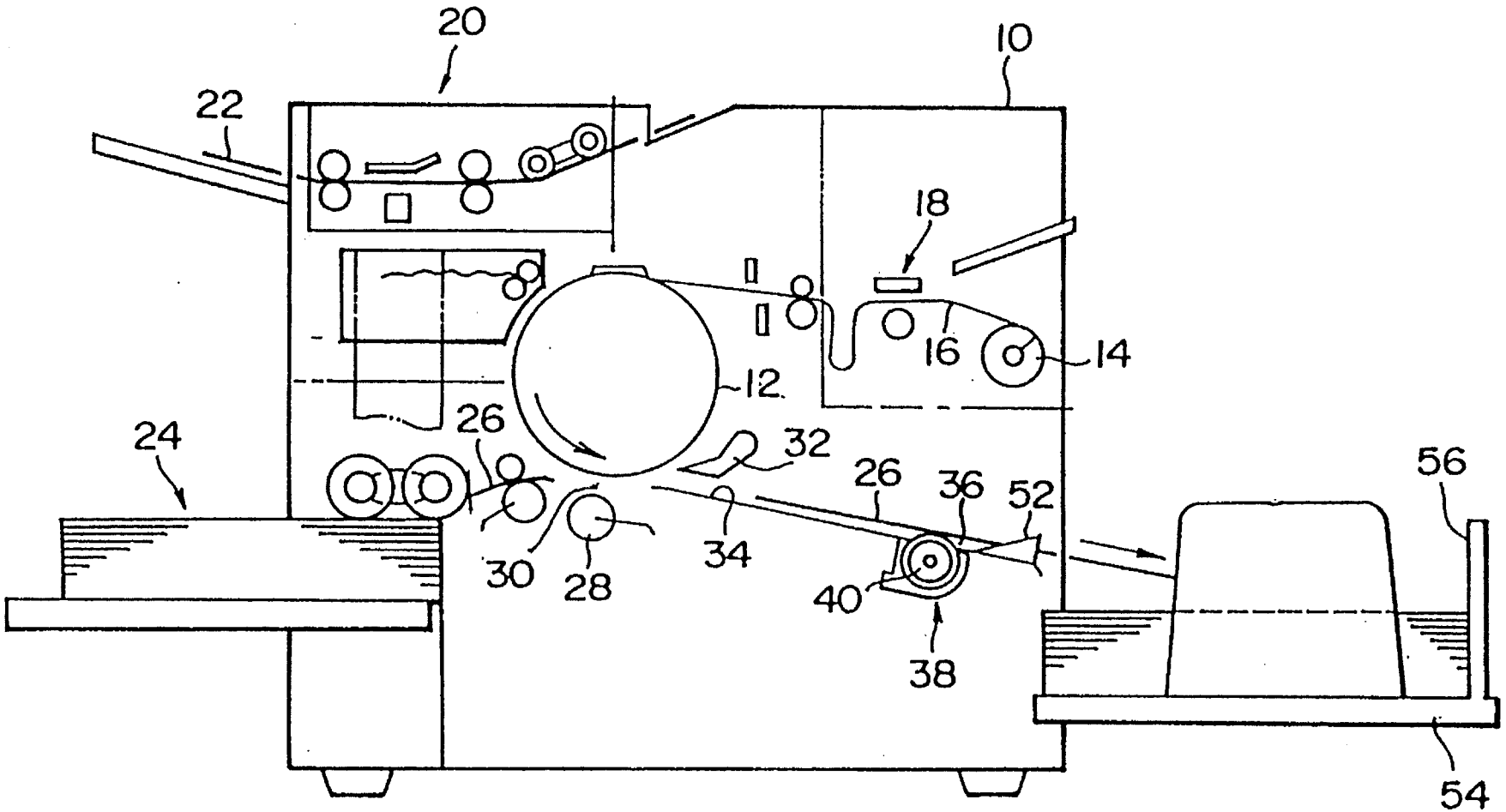
FIG. 1 is a schematic side view of an example of a rotary stencil printer incorporating an embodiment of the sheet transfer device according to the present invention.

FIG. 1 shows in a longitudinally sectional view in a somewhat schematic fashion an embodiment of a rotary stencil printer in which the sheet transfer device according to the present invention is incorporated, 10 designates a housing of the printer, within which a printing drum 12 having a perforated circumferential wall is mounted to be selectively driven for rotation by a driving means not shown in the figure. The printing drum 12 is adapted to carry as wrapped therearound a stencil sheet 16 taken out from a stencil sheet supply roll 14 and perforated at a stencil sheet perforating part 18. In the stencil sheet perforating part 18, the stencil sheet is perforated according to the information read out from an original 22 at an original read out part 20. When the perforated stencil sheet has been wrapped around the printing drum, ink is supplied from an ink supply means incorporated at the inside of the printing drum but not shown in the figure to the stencil sheet from the inside of the printing drum, while print sheets 26 are successively supplied from a sheet supply part 24 to a nipping region 30 between the printing drum 12 and a back press roller 28 with each sheet being pressed against the printing drum by the back press roller such that each sheet is applied with a printing on its surface facing the printing drum. The sheet thus applied with a printing and thereafter tends to follow the printing drum, being somewhat as adhered thereto by the viscosity of the ink as the sheet is peeled off from the printing drum starting at a leading edge thereof by a detaching claw 32. The above-mentioned construction is well known in the art as a fundamental construction of a rotary stencil printer.

The print sheet peeled off from the printing drum 12 by the detaching claw 32 is received on a sheet guide surface 34 of the sheet transfer device according to the present invention. The sheet guide surface 34 is a smooth surface adapted to allow the sheet 26 to easily move therealong in contact therewith. As shown better in FIG. 2, the sheet guide surface 34 is formed with an air intake port 36 at a part thereof. From this air intake port 36 a part of the circumferential portion of a fan rotor 40 of a fan 38 project.

The fan 38 has a construction such that a fan rotor 40 is rotatably mounted by a shaft 42, said rotor having a number of blades 44 arranged around the rotary shaft 42, each blade having a curved airfoil section uniform along the central axis of the rotor, and adapted to draw air therein through the air intake port 36 and to discharge the air through an air discharge port 46 (FIG. 3) when it is driven to rotate in a direction shown by arrow A.

Figure 3:
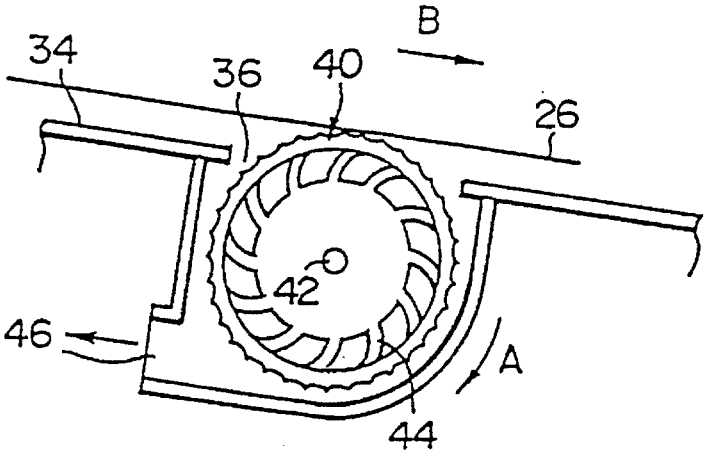
FIG. 3 is a more detailed sectional view of the fan shown in FIGS. 1 and 2.
Figure 4:
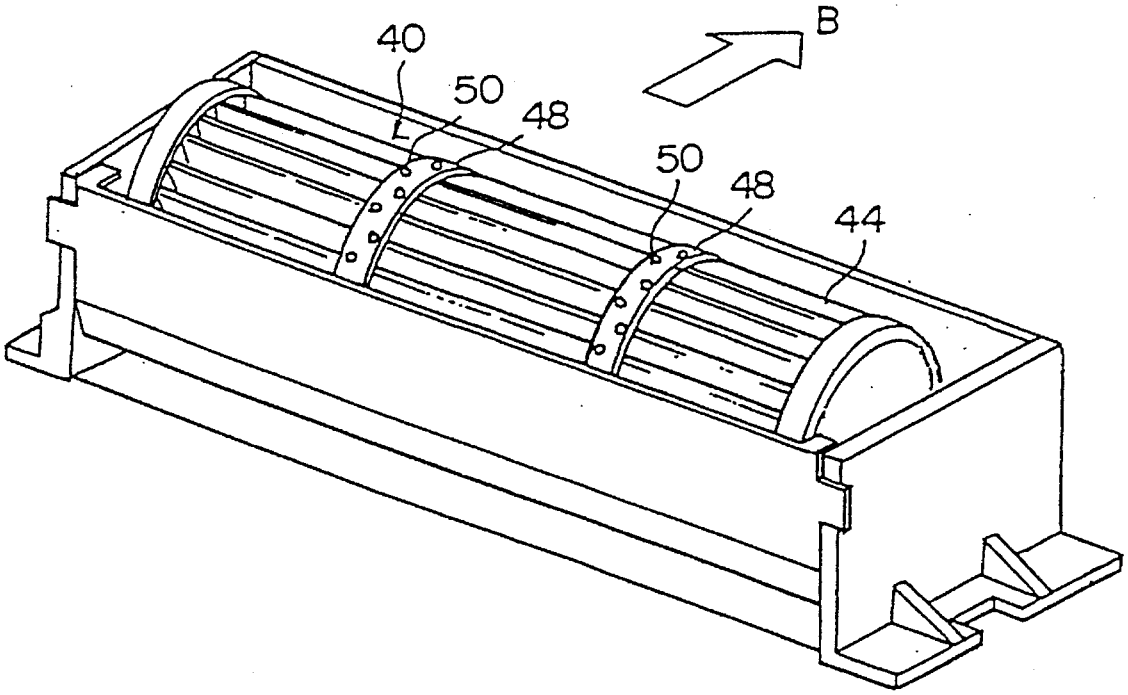
FIG. 4 is a more detailed perspective view of the fan shown in FIGS. 1 and 2.

In the shown embodiment, the fan rotor 40 has two annular members 48 (FIG. 4) such as annular rubber belts at two intermediate positions along the axis thereof. The annular members 48 each have a number of projections 50 on an outside surface thereof such that when it contacts with the sheet 26 as shown in FIG. 3, an increased friction force is exerted at the contact point, so that a resilient driving force is applied to the sheet in the direction of arrow B according to the rotation of the fan rotor 40 as it is increased.

Further, in the shown embodiment, a pair of raised portions 52 (FIGS. 2 and 7) are provided on the sheet transfer surface 34 at a position downstream of the fan rotor 40 as viewed in the sheet transfer direction so as to engage opposite side edge portions of the sheet at a rear surface thereof and to lift the opposite side edge portions upward. By the provision of these raised portions, a sheet which is transferred while contacting the circumferential portion of the fan rotor 40 by being drawn thereto from a rear side thereof as the position of the air intake port 36 remains in contact with the sheet guide surface 34 at a central portion thereof while lifted upward at the opposite side edge portions thereof by the raised portions 52, whereby the sheet is bent into a U-shape as viewed in the direction of transfer of the sheet and is thereby stiffened. The sheet is thus driven in the sheet transfer direction in such a stiffened condition with the central portion thereof being drawn to the circumferential portion of the fan rotor 40 until the trailing edge end of the sheet passes over the air intake port 36, and thereafter the sheet advances by its inertia due to the momentum given to the sheet at the moment when the trailing end thereof removes from the contact with the fan rotor 40 into a sheet receptacle 54 until the leading edge thereof abuts against an end wall 56 for truing up the leading edge of the sheet.

Figure 5:
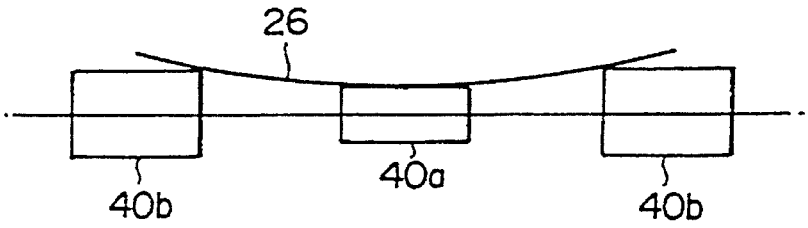
FIG. 5 is a schematic view showing another embodiment of the fan rotor.
Figure 6:
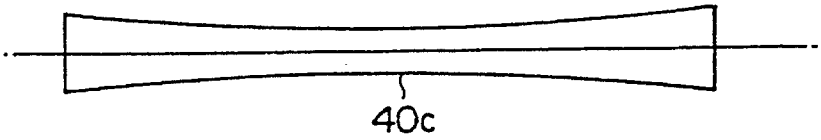
FIG. 6 is a schematic view showing still another embodiment of the fan rotor.

In the embodiment described above, the fan rotor has a uniform diameter all along the axial length thereof to have the shape of a cylinder. However, the fan rotor may have such a construction as shown in FIG. 5, comprising a fan rotor **40*a* positioned at a center and having a relatively small diameter and a pair of fan rotors 40*b* positioned on opposite sides of the central fan rotor and having a relatively large diameter. By changing the diameter of the fan rotors adapted to contact the central portion and the opposite side edge portions of the sheet in the above-mentioned manner, the sheet can be bent into a U-shape without the provision of the pair of raised portions 52 provided in the embodiment shown in FIGS. 1 and 2. The central fan rotor 40*a* and the pair of opposite side fan rotors 40*b* may be driven to rotate in unison by a common rotary shaft. However, if it is acceptable for the driving mechanism to become a little complicated, the central fan rotor 40*a* and the opposite side fan rotors 40*b* may be driven at a certain ratio of rotation speed so that the circumferential speed of all fan rotors is the same, or any difference in the circumferential speed may be given between the central and opposite side rotors such that a desirable sheet transfer performance is obtained. FIG. 6 is a diagrammatic view similar to FIG. 5 showing still another embodiment with respect to the fan rotor 40. In this embodiment, the diameter of a single fan rotor 40*c* is continually changed from a relatively small diameter at a central portion thereof toward a relatively large diameter at opposite end portions thereof. When this type of fan rotor is used, the above-mentioned pair of raised portions 52** may also be omitted.

A curved supporting structure by the fan rotor itself as shown by FIG. 5 or 6 can be accomplished by changing the thickness of an annular member mounted around the fan rotor.

Figure 2:
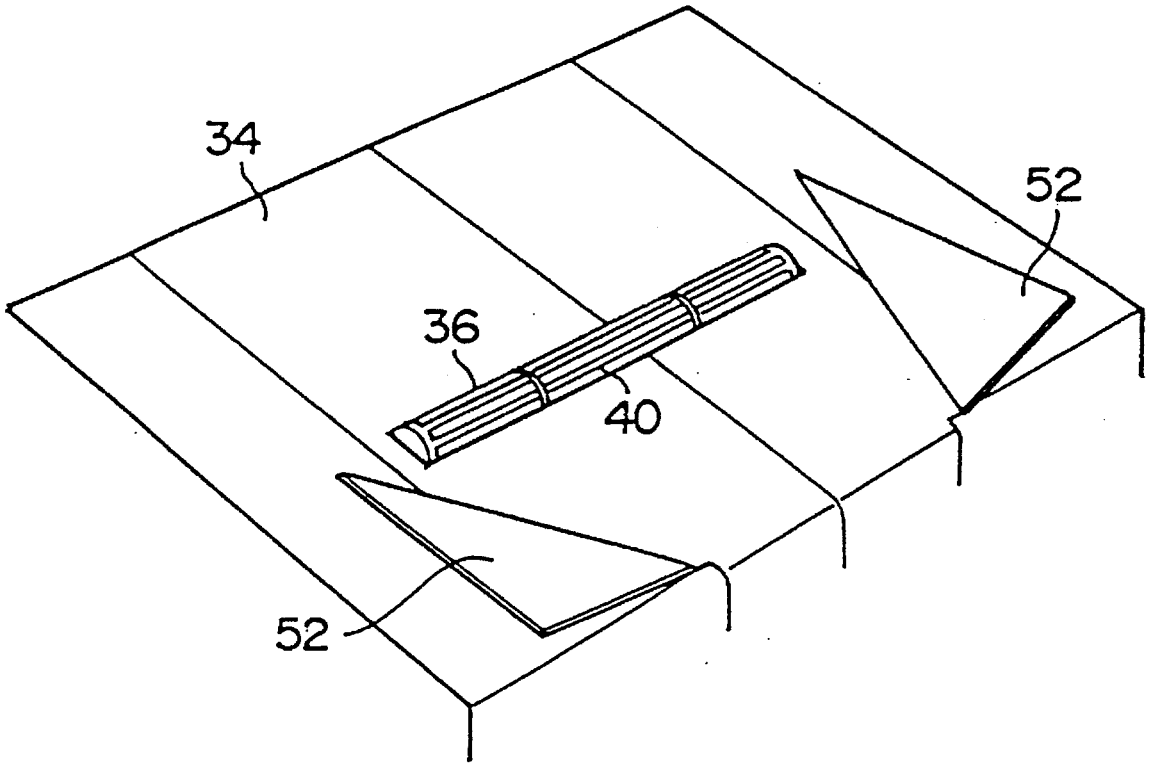
FIG. 2 is a schematic perspective view showing only the sheet transfer device shown in FIG. 1.
Figure 7:
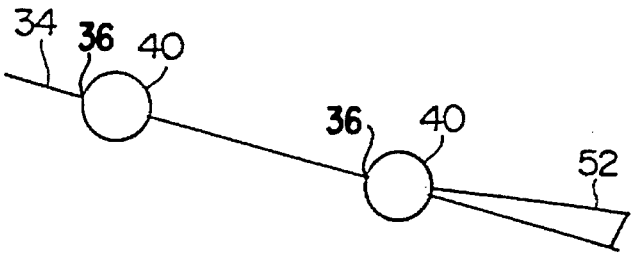

Although the air intake port 36 and the fan rotor 40 are respectively provided at one position along the sheet transfer route in the embodiment shown in FIGS. 1 and 2, such an air intake port may be provided respectively at two positions along the sheet transfer route as diagrammatically shown in FIG. 7. By such an arrangement the sheet peeled off from the printing drum can be caught as drawn onto the sheet guide surface at a position closer to the printing drum and the sheet is definitely transferred by the combination of the air intake port and the fan rotor up to a position closer to the sheet receptacle.

Figure 8:
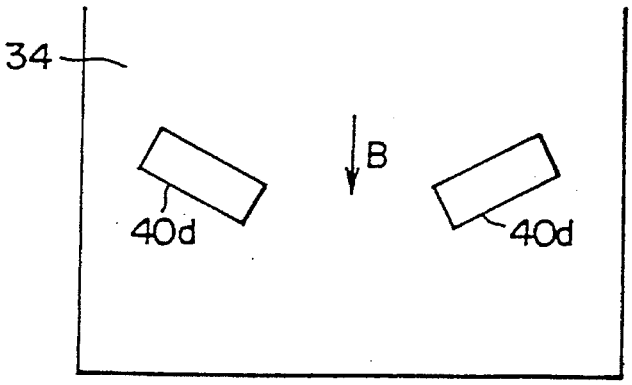
FIG. 8 is a schematic view showing still another embodiment of the sheet transfer device according to the present invention.

FIG. 8 is a diagrammatic view showing still another embodiment in which two fan rotors **40*d* are arranged to present an angle different from 90 degree relative to the sheet transfer direction B. When the pair of fan rotors 40*d* are inclined relative to the sheet transfer direction B as shown in the figure, it is possible to apply an expanding and developing function to the sheet. If such an arrangement of inclining the axis of the fan rotor is applied to a pair of fan rotors, the embodiment shown in FIG. 5 may further be modified such that the opposite side fan rotors 40*b* are skewed to follow the contour of the U-shaped bending of the sheet. Further, in such a case, the diameter of the fan rotors 40*a* and 40*b*** may be the same, whereby all of the rotors may be driven at the same rotation speed to provide the same circumferential speed.

Although the present invention has been described in detail with respect to several embodiments thereof applied to a rotary stencil printer, it will be apparent for those skilled in the art that the present invention is not limited to such an application or embodiments but may be applied to various machines or apparatus and various modifications are possible with respect to the shown embodiments.

I claim:

1. A sheet transfer device comprising a sheet guide surface, and a fan having a fan rotor and a shaft for rotatably supporting said fan rotor, said fan rotor drawing air therein from a circumferential region thereof radially inwardly, said fan having an air intake port open at a part of said sheet guide surface with a circumferential portion of said fan rotor projecting from said air intake port above said sheet guide surface, said circumferential portion of said fan rotor projecting above said sheet guide surface being adapted to move in a direction of transfer of a sheet on said sheet guide surface when said fan rotor is rotated.

2. A sheet transfer device according to claim 1, arranged at a position to transfer a sheet discharged from a nipping region between a printing drum and a back press roller of a printer with a first surface of said sheet having been applied with a printing according to a rotation of said printing drum toward a sheet receptacle, wherein said sheet guide surface slidably receives the sheet discharged from said nipping region along with a second surface thereof opposite to said first surface.

3. A sheet transfer device according to claim 2, wherein a position at which said circumferential portion of said fan rotor projects above said sheet guide surface is less distant from said nipping region along a route of transfer of the sheet than a length of the sheet in a direction of transfer thereof.

4. A sheet transfer device according to claim 1, wherein said circumferential portion of said fan rotor projecting above said sheet guide surface comprises an annular member for increasing a friction in contact with the sheet.

5. A sheet transfer device according to claim 1, wherein said sheet guide surface includes a pair of raised portions at a position downstream of said circumferential portion of said fan rotor projecting above said sheet guide surface as viewed in the direction of transfer of the sheet so as to lift opposite side edge portions of the sheet above a central portion thereof so as thereby to bend the sheet into a U-shape as viewed in the direction of transfer of the sheet.

6. A sheet transfer device according to claim 1, wherein said fan rotor has a larger diameter at opposite end portions thereof corresponding to opposite side portions of said sheet guide surface than at a central portion thereof.

7. A sheet transfer device according to claim 6, wherein said fan rotor is provided by a combination of a plurality of fan rotors having relatively different diameters such that said combination presents a larger diameter at opposite end portions thereof corresponding to opposite side portions of said sheet guide surface than at a central portion thereof.

8. A sheet transfer device according to claim 2, wherein at least two sets of said fan rotor and said air intake port are provided along said sheet guide surface as spaced from one another in the direction of transfer of sheet.

9. A sheet transfer device according to claim 1, wherein a pair of said fan rotors are provided with a symmetrical inclination relative to the direction of transfer of sheet together with a corresponding pair of said air intake ports so as to bend a sheet transferred thereby into a U-shape as viewed in said direction of transfer of the sheet.

* * * * *